US008147944B2

(12) United States Patent
Moore

(10) Patent No.: US 8,147,944 B2
(45) Date of Patent: Apr. 3, 2012

(54) VISION DREAM BOARD BOOK COVER

(75) Inventor: Rachel Latrell Moore, Lizella, GA (US)

(73) Assignee: Rachel Latrell Moore

( * ) Notice: Subject to any disclaimer, the term of this patent is extended or adjusted under 35 U.S.C. 154(b) by 334 days.

(21) Appl. No.: 12/586,223

(22) Filed: Sep. 18, 2009

(65) Prior Publication Data

US 2011/0068567 A1 Mar. 24, 2011

(51) Int. Cl.
*B42D 3/02* (2006.01)

(52) U.S. Cl. ..... 428/126; 281/34; 281/35; 40/654.01

(58) Field of Classification Search ..... 428/126; 281/34, 35; 40/654.01, 649
See application file for complete search history.

(56) References Cited

U.S. PATENT DOCUMENTS

| | | | | |
|---|---|---|---|---|
| 489,970 | A * | 1/1893 | Mason | 281/34 |
| 7,478,837 | B2 | 1/2009 | Silverman | |
| 2005/0225072 | A1 * | 10/2005 | Elwell | 281/20 |

* cited by examiner

*Primary Examiner* — Alexander Thomas

(57) ABSTRACT

An apparatus formed or molded from a transparent material to cover a book, composition book, or notebook of various sizes is provided. The transparent apparatus is double layered with an opened ended top edge to allow for paper of various weights to be inserted within the double layered body and mutually spaced inward folded portions. The inward folded portions are deep enough to slide the front and back covers of a book, composition book, or notebook into it for a secure fit. The inward folded edges are affixed and sealed through all thickness of the cover body at the bottom edge.

2 Claims, 3 Drawing Sheets

VISION DREAM BOARD BOOK COVER

BACKGROUND OF THE INVENTION

The single layered book cover is known. Such book cover includes edges on top and bottom forming an opening for the insertion of the front and back cover of a book on the inside folded portion as related to U.S. Pat. No. 7,478,837, drawings page 3, FIG. 7. However, in the prior art, the single layered folding piece of material does not allow insertion of paper from the top edge of the body and top of the inward folded edges.

SUMMARY OF THE INVENTION

The present invention relates to a transparent book cover, wherein designed double layered with opened ended top edges. The object of the present invention is to provide a book cover which allows for top insertion of paper in various weights such as, but not limited to poster board thickness, being used as a vision dream board inserted between the transparent double layered body and inward folded portions.

There is provided a book cover where the inward folded edges are affixed and sealed through all thickness of the cover body at the bottom edge, leaving the top edge opened for insertion. The inward folded portions are deep enough to slide the front and back covers of a book, composition book, or notebook into it for a secure fit.

BRIEF DESCRIPTION OF THE DRAWINGS

The various objects of the present invention will be more readily understood from the following detailed description when read in conjunction with the appended drawings.

DETAILED DESCRIPTION OF THE PREFERRED EMBODIMENTS

With reference to all figures, FIGS. 1, 2, 3, and 4, the embodiment is formed from a suitable transparent material, such as, but not limited to, flexible clear vinyl with water repellent properties. The adhered or open ended edges may be heat sealed, pressed, or sewn.

Figure 1:
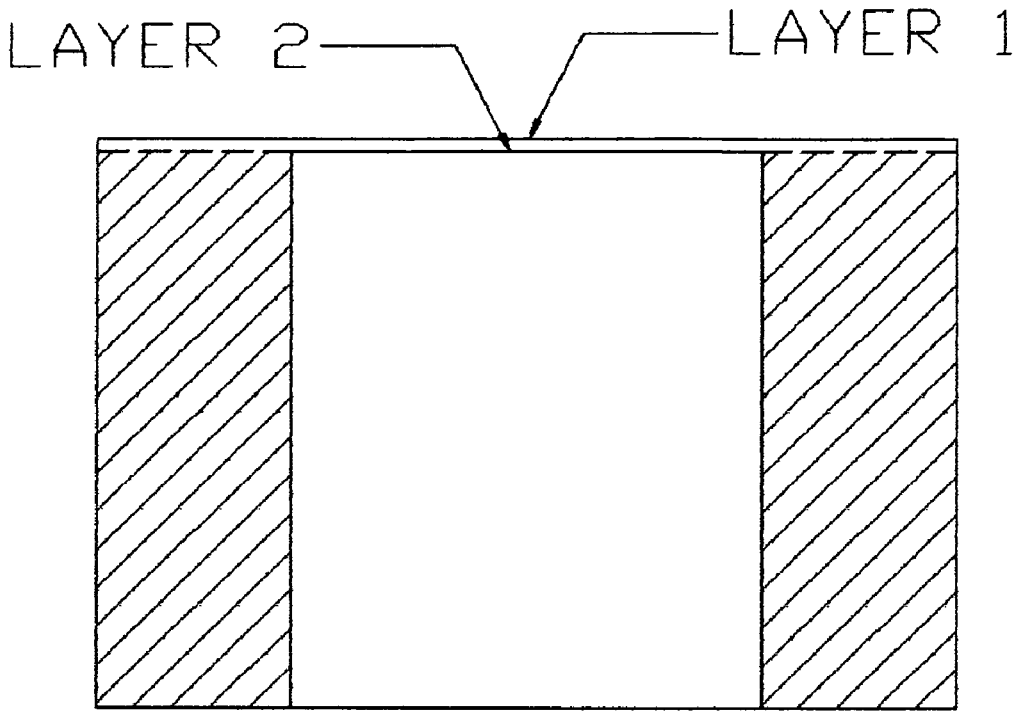
FIG. 1 shows an embodiment with two layers of construction material, layer 1 and layer 2 of the present invention are unattached on the top edge where paper of various weights can be applied prior to or after the insertion of a book, composition book, or notebook within the side folds.

In FIG. 1 the top opened edges between layers 1 and 2 are emphasized of the present invention. Paper of various weights may be inserted between layer 1 and layer 2, where the inserts are intended for, but not limited to vision boards and art work. The bottom edge is sealed, pressed, or sewn through all thickness to adhere the inward folded portions to the body.

Figure 2:
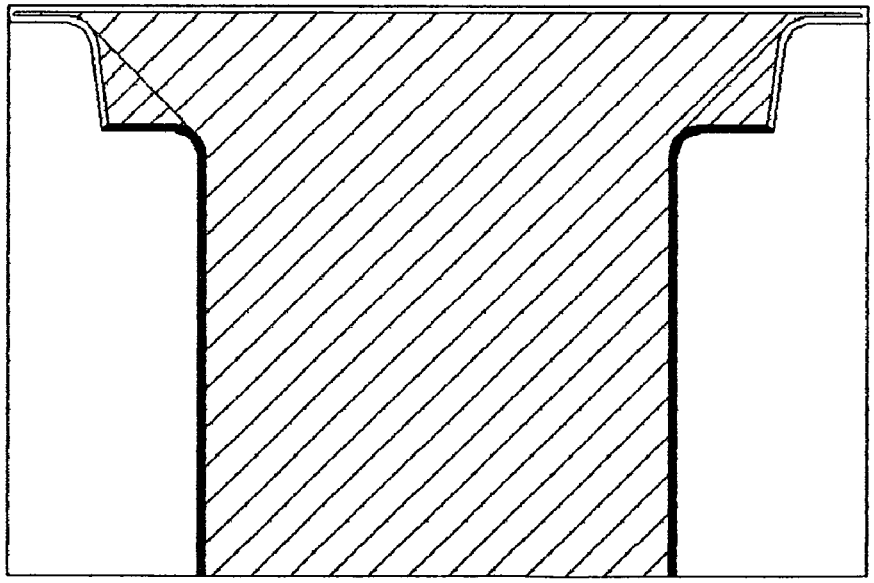
FIG. 2 is a perspective view of the present invention detailing the inner side folds with opened ended top edges extending over full circumference of the body.

FIG. 2 shows the design uniqueness of the present invention where the opened ends continue in full circumference of the top edge including the vertical inward folded portions. Inserts may be placed between the two layers of the body and of the two layers of the vertical inward folded portion. The bottom edge is sealed, pressed, or sewn through all thickness to adhere the inward folded portions to the body.

Figure 3:
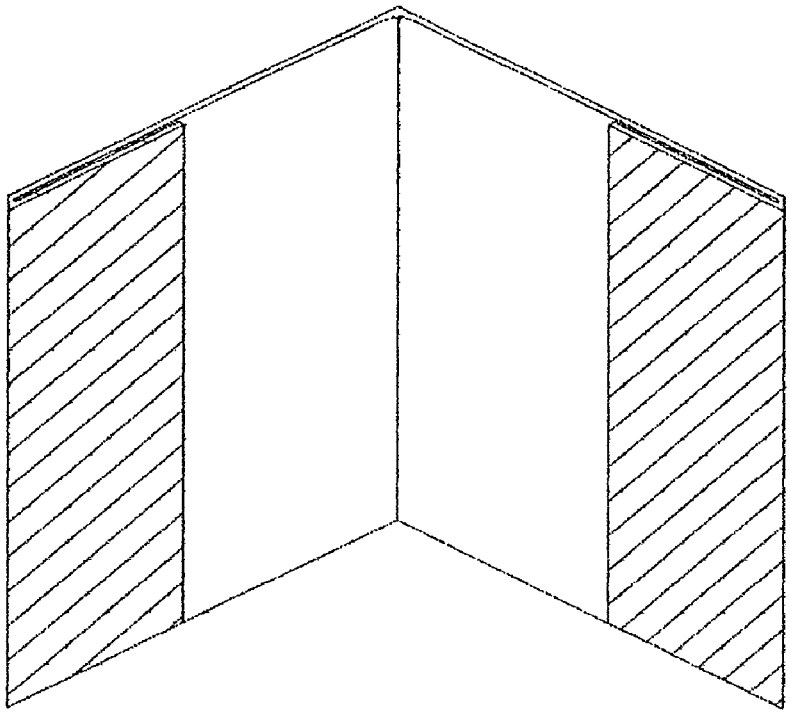
FIG. 3 is a perspective view of the present invention in an angled fold vertical position with a fold line.
Figure 4:
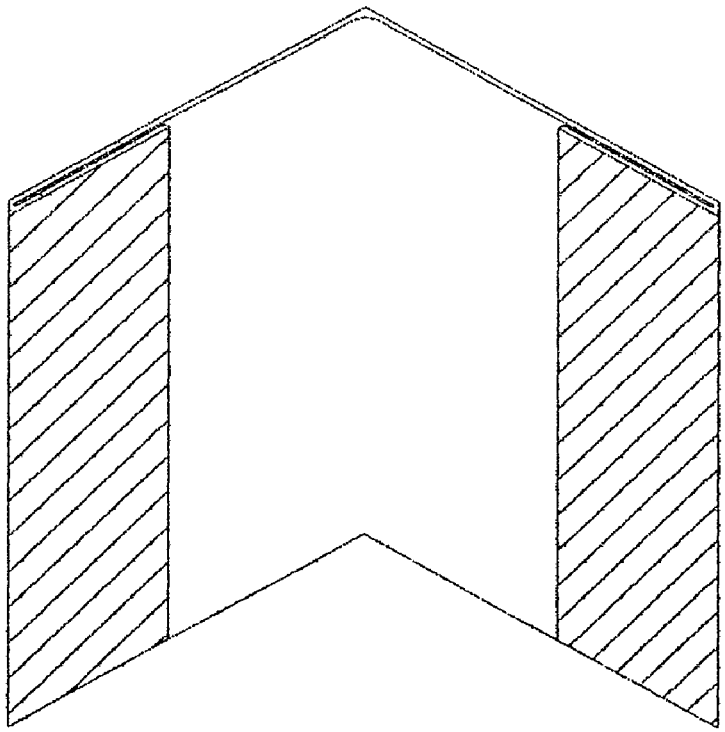
FIG. 4 is a perspective view of the present invention in an angled fold vertical position without a fold line.

FIGS. 3 and 4, shows vertical isometric views of the present invention with and without a center fold line.

Figure 5:
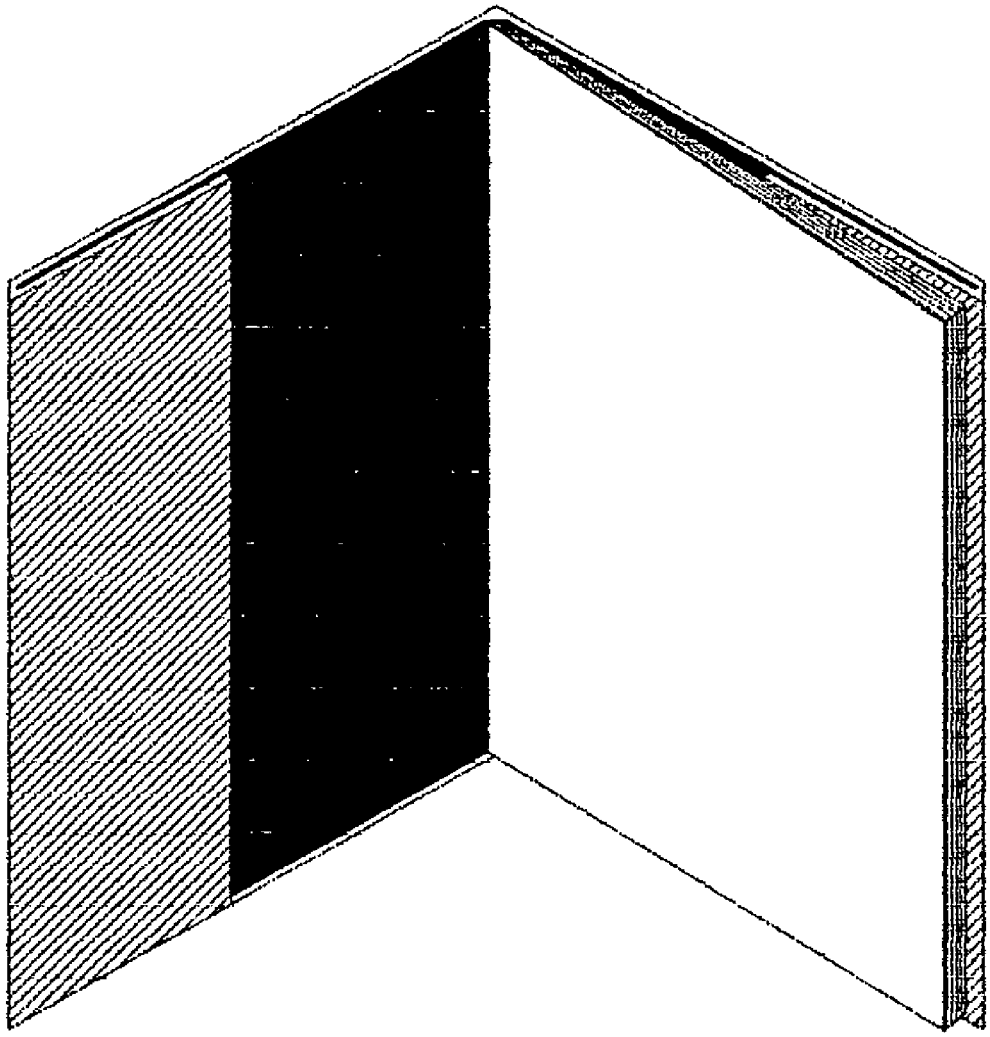
FIG. 5 is a perspective view of the present invention as applied to a composition notebook in vertical position.

FIG. 5 shows vertical view of the present invention being applied to cover a composition notebook.

An advantage of the present invention is that the body is double layered having the top edge opened over the full circumference of the body including the top edges of the inward folded portions.

Although the present invention has been described with reference to the preferred embodiments, it will be understood that the invention is not limited to the details described thereof. Various substitutions and modifications in materials used, size, and methods of adhesion will occur during manufacturing process. Therefore, all such substitutions and modifications are intended to be embraced within the scope of the invention as defined in the appended claims.

What is claimed is:

1. A cover for a book, composition book or notebook comprising:

a body portion comprising two superimposed transparent layers having an opened top edge between the two transparent layers, a bottom edge and two opposite side edges extending between the top and bottom edges;

inward folded pieces extending laterally from the opposite sides of said body portion and extending from the top edge of the body portion to the bottom edge of the body portion, wherein each said inward folded pieces comprise two superimposed transparent layers having opened top edges; and wherein the bottom edges of the body portion are sealed or sewn together and bottom edges of the inward folded pieces are sealed or sewn together.

2. The cover as recited in claim 1, wherein the bottom edges of the inward folded pieces are sealed or sewn to adhere the inward folded pieces to the body portion.

* * * * *